US006755380B2

(12) United States Patent
Pace

(10) Patent No.: US 6,755,380 B2
(45) Date of Patent: Jun. 29, 2004

(54) PORTABLE NAIL POLISH HOLDER

(76) Inventor: Jasmine Pace, 17 Hayrick La., Commack, NY (US) 11725

( * ) Notice: Subject to any disclaimer, the term of this patent is extended or adjusted under 35 U.S.C. 154(b) by 0 days.

(21) Appl. No.: 10/293,416

(22) Filed: Nov. 13, 2002

(65) Prior Publication Data

US 2004/0089774 A1 May 13, 2004

(51) Int. Cl.[7] ..... A47G 23/02
(52) U.S. Cl. ..... 248/146; 248/910
(58) Field of Search ..... 248/146, 910, 248/133, 314, 311.2, 309.1; 211/74; 220/636, 632; D28/73; D3/27; D99/36

(56) References Cited

U.S. PATENT DOCUMENTS

| | | | | |
|---|---|---|---|---|
| 2,000,302 | A | | 5/1935 | Solomon |
| 2,748,952 | A | | 6/1956 | Fleit et al. |
| 2,806,131 | A | * | 9/1957 | Palmer |
| 3,028,702 | A | | 4/1962 | St. Cyr |
| 3,029,058 | A | | 4/1962 | Himler |
| 3,090,590 | A | | 5/1963 | Hester |
| 3,220,685 | A | | 11/1965 | Himler |
| 3,312,436 | A | * | 4/1967 | Beghetto, Jr. |
| D221,725 | S | | 9/1971 | Tatum ..... D3/19 |
| 3,848,281 | A | | 11/1974 | Mathews ..... 5/337 |
| 3,885,578 | A | | 5/1975 | Hicks ..... 132/88.5 |
| 3,964,709 | A | | 6/1976 | LaBelle et al. ..... 248/133 |
| D252,828 | S | | 9/1979 | Davidson ..... D28/61 |
| 4,788,916 | A | | 12/1988 | Saxton ..... 108/43 |
| 4,795,117 | A | * | 1/1989 | Siteman ..... 248/146 |
| 4,964,600 | A | * | 10/1990 | Lee ..... 248/146 |
| 5,492,320 | A | | 2/1996 | Hoffman et al. ..... 273/415 |
| 5,743,500 | A | | 4/1998 | Northway et al. ..... 248/146 |
| 5,909,811 | A | | 6/1999 | Harris ..... 206/581 |
| D441,914 | S | | 5/2001 | Armour ..... D28/73 |

* cited by examiner

*Primary Examiner*—Gwendolyn Baxter
(74) *Attorney, Agent, or Firm*—Alfred M. Walker

(57) ABSTRACT

A portable holder for a bottle of nail polish, has an upwardly extending weighted sack around the walls which contains small weighted beads. This is wrapped around a rigid, flat based, preferably cylindrical cup with a resilient piece of foam material inside the cylindrical cup The center of the foam piece is cut in a circle, small enough in size, but can accommodate any nail polish bottle shape (i.e., elongated square, square, round in cross section). The holder is covered with ornamental fabric to attract target audience age groups of 10–50 year old females.

5 Claims, 1 Drawing Sheet

Figures 1, 2:
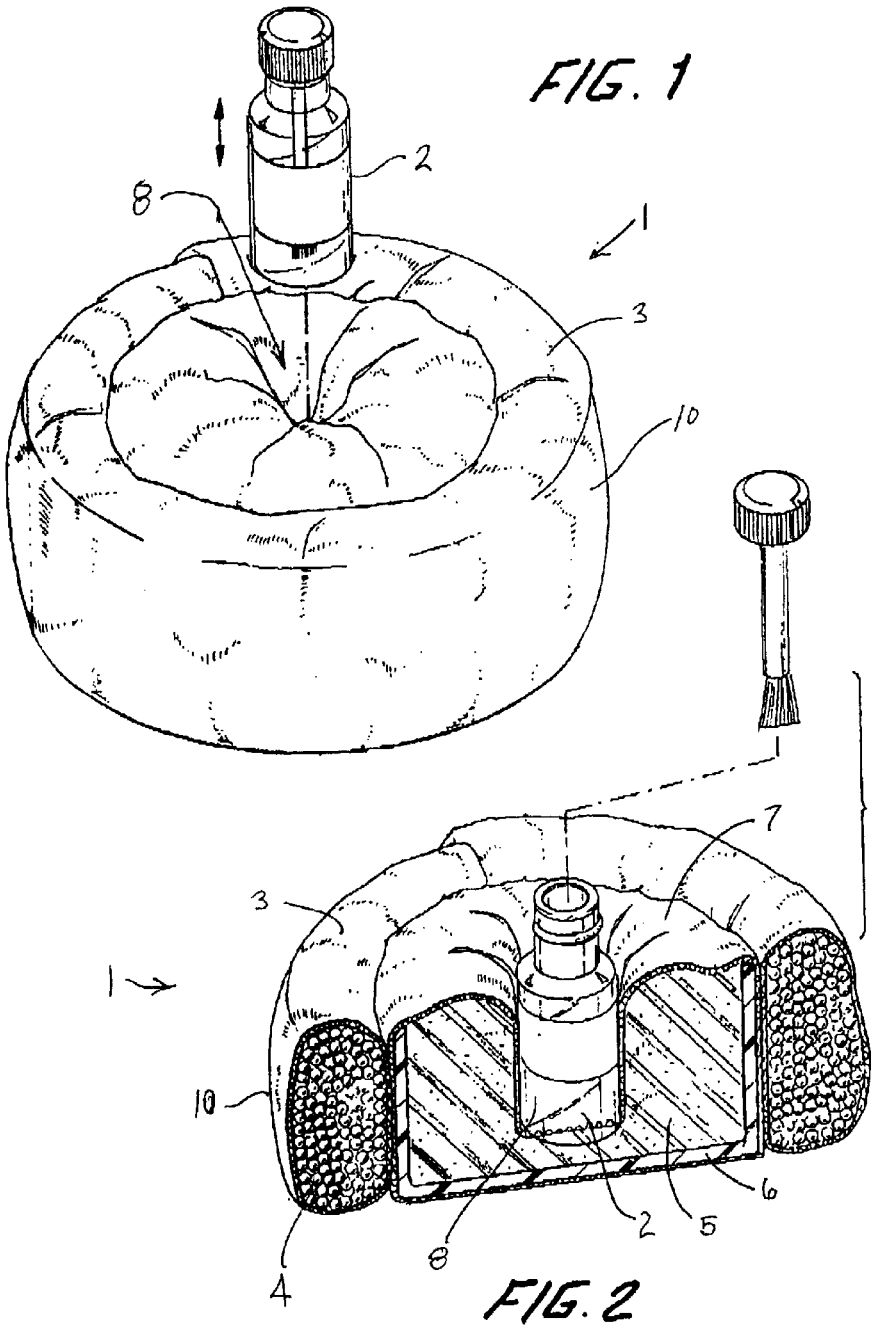

2
8
1
3
10
7
3
1
10
6
2
5
8
4

PORTABLE NAIL POLISH HOLDER

FIELD OF INVENTION

The present invention relates to containers for nail polish bottles on unstable, soft surfaces.

BACKGROUND OF THE INVENTION

Currently, the only way a person can apply nail polish is by putting the nail polish on a sturdy base such as a table. The user will need to unscrew the cap, use the brush to apply the polish, and continuously re-dip to apply to the other nails. This is not convenient or practical when most people do their nails or their daughter's nails in bed, on the sofa, or on the floor. Even when the surface is flat, the likelihood and incidence that the bottle will tip over and nail polish will be spilled is very high.

Among related patents include U.S. Design Pat. No. D441,914 of Armour, which describes a nail polish bottle holder, which is a sack with an open hole in the middle.

U.S. Design Pat. No. 221,725 of Tatum describes a lipstick dispenser retainer well which is rigid, and which is not made with a flexible foam. A soft layer is provided around the rigid well, but it does not directly contact the lipstick dispenser.

U.S. Pat. No. 5,492,320 of Hoffman, is a disc-shaped flat bean bag structure with no other support structure, that doesn't hold nail polish bottles.

U.S. Pat. No. 3,028,702 of St.Cyr describes a drinking glass coaster having a bean bag base, but which uses leaf spring members to hold the glass in place. It doesn't add an upwardly extending sleeve which is weighted to stabilize the coaster.

U.S. Pat. No. 3,848,281 of Mathews describes a toroidal foam cushion to hold loose items therein. Mathews '281 has a cover of unitary structure removed or applied without fasteners.

U.S. Pat. No. 4,788,916 of Saxton describes a weighted tray with a bean bag base, but which does not rise upwardly along the sides of a cylindrical cup container.

U.S. Pat. No. 5,743,500 of Northway describes a flat, non-weighted strap-like apparatus with a small pocket in the center for holding nail polish bottles.

U.S. Pat. No. 4,795,117 of Siteman describes a bottle-steadying platform of formable material, but it does not have upwardly extending weighted sides.

U.S. Pat. No. 3,029,058 of Himler describes a rigid nail polish bottle holder which can only be used on a even surface, otherwise it will tip over.

U.S. Design Pat. No. 252,828 of Davidson describes a nail polish tray which is also limited to a flat, even surface. This is not a weighted item, provides no stability, has no flexibility and will not hold nail polish bottles securely.

U.S. Pat. No. 3,964,709 of LaBelle and U.S. Pat. No. 3,220,685 of Himler both describe rigid, flat bottomed nail polish holders which are also not weighted and which must be used on a flat, even surface.

OBJECT OF THE INVENTION

It is therefore an object of the present invention to provide a portable and stable nail polish bottle holder which can be conveniently used on non-flat surfaces, such as bed covers or carpeting.

SUMMARY OF THE INVENTION

In keeping with these objects and others which may become apparent, the nail polish bottle holder of the present invention is a portable, sturdy, small and attractive holder of a nail polish bottle that frees the user to polish her nails anywhere, anytime on almost any surface, without the fear of tipping or spilling the nail polish. The annular weighted component in this invention is wrapped around the side of the holder, thus giving the nail polish bottle holder of this invention even more stability and making it less prone to being accidentally tipped over. The different fabric covering is designed to appeal and attract different target audiences from all age groups.

In contrast to Armour '914, the present invention is different because the sides of the nail polish holder of the present invention are weighted with beads and the interior is filled with compressible, resilient foam that will accommodate any shape nail polish bottle, such as being circular, heart shaped, triangular or square in cross section. Armour '914 describes a sack with a open hole in the middle.

In contrast to Tatum '725, the present invention is different because the sides are weighted with beads and interior is filled with resilient foam that will accommodate any shape nail polish bottle. The retainer well of Tatum '725 is rigid, not made with a flexible foam like that of the present invention. In contrast to Hoffman '320, the center well of the present invention is not a rigid component, but of is made of compressible, flexible foam which will accommodate any shape nail polish bottle. In contrast to the holder described in Hoffman '320, which is a disc-shaped flat bean bag structure with no other support structure, nor which can hold nail polish bottles, the present invention includes a compressible well surrounded by an outer weighted ring which conforms to an irregular surface, such as bed covers.

In contrast to St.Cyr '702, the present invention is different because the flexible sides of the nail polish holder's sides are weighted (not the base) to provide extra stability. The bean bag sleeve of the present invention has a higher center of gravity than St. Cyr '702, but the weight is distributed around the entire unit thus providing stability on uneven, irregular surfaces.

In contrast Mathews '281, the nail polish bottle holder of the present invention is different because it is weighted on its side walls which are of a rigid, flat-based form and it holds nail polish bottles securely therein.

In contrast to Saxton '916, the present invention is different because the nail polish bottle holder described herein has weighted sidewalls to provide extra stability. In contrast to Northway '500, the present invention describes a weighted item, thus holding bottles of nail polish securely. Northway '500 describes a flat, non-weighted item with a small pocket in the center for holding nail polish bottles.

In contrast to-Siteman '117, the nail polish holder of the present invention is different because Siteman '117 is not weighted and will not be secure on an uneven surface.

Himler '058, describes a nail polish bottle holder which can only be used on a even surface. The nail polish bottle holder of the present invention can used on any surface without it tipping over.

Davidson '828 describes a nail polish tray which, is also limited to a flat, even surface. This is not a weighted item, provides no stability, has no flexibility and will not hold nail polish bottles securely.

In contrast to the present invention, LaBelle '709 and Himler '685 both describe rigid, flat bottomed nail polish holders, which are also not weighted, and which must be used on a flat, even surface.

Therefore, unlike the prior art, the present invention provides a portable holder for a bottle of nail polish, which is stabilized upon an uneven surface, such as upon bed covers, by an upwardly extending weighted sack around the walls which contains small weighted beads. This sack is wrapped around a rigid, flat based cup, which is preferably cylindrical, with a resilient piece of compressible, resilient foam material inside the cylindrical cup. The center of the foam piece is cut in a circle, small enough in size, but can accommodate any nail polish bottle shape.

It is noted that while the preferred embodiment for the cup is cylindrical, it can assume other geometric shapes, such as square, oval, heart shaped, etc.

BRIEF DESCRIPTION OF THE INVENTION

The present invention can best be understood in connection with the accompanying drawings, in which:

FIG. 1 is a perspective view of the nail polish holder of the present invention, wherein the arrows indicate the direction of movement of a nail polish bottle into and out of the nail polish holder of the present invention; and, FIG. 2 is a partial perspective view thereof, shown in cross section.

DETAILED DESCRIPTION OF THE INVENTION

FIG. 1 depicts the full frontal view of the nail polish bottle holder (1) of the present invention, holding a bottle of nail polish therein. FIG. 2 shows the internal construction in cross section.

With the initial reference to FIG. 1 and FIG. 2, the nail polish bottle holder (1) for holding a nail polish bottle (2) therein, is made from a rigid cup (6), preferably cylindrical, being approximately 3 inches in height and having a flat base and at least one upwardly extending wall surrounding a periphery of the cup (6). A piece of compressible resilient foam well (5) is fitted into the rigid, flat-based cup 6. In addition, a small cutout (8) in the center of the foam well (5) is made. This cutout (8) is formed within the well of compressible, resilient material, such as foam, for holding a bottle of nail polish.

FIG. 2 shows the nail polish bottle holder layer by layer. Outside of the rigid flat-based cup (6), with the compressible, resilient foam well (5) inside, is an outer, upwardly extending sleeve (10), of weighted beads (4), that is wrapped and adhered to the walls of the rigid flat-based cup (6). The sleeve (10) includes a plurality of weighted beads (4), thus giving it stability and providing the sturdiness of the unit. The outermost layer of the nail polish caddy is ornamental fabric (3), which covers the entire nail polish bottle holder (1), including the compressible, resilient foam well (5) and cutout (8) provided in the middle thereof. Extra room is given so that the fabric cover (3) may be inserted into the compressible, resilient well (5) for which the nail polish bottle sits securely.

It is further noted that while the preferred embodiment for the cup (6) is cylindrical, it can assume other geometric shapes (not shown in the drawings), such as square, oval, heart shaped, etc.

Furthermore, other modifications may be made to the present invention, without departing from the scope of the invention, as noted in the appended claims.

I claim:

1. A form-fitting nail polish bottle holder in combination with a cylindrical nail polish bottle, comprising in combination:

a cylindrical nail polish bottle;

a rigid cylindrical cup having a flat base, said cylindrical cup further having a compressible resilient foam well fitted herein, said compressible, resilient foam well having a cutout in a center thereof, said cutout formed within said well of compressible, resilient material, holding said bottle of nail polish therein, said rigid cylindrical cup being enclosed by an upwardly extending sleeve of weighted beads, and, said nail polish holder being covered by an outer layer.

2. The portable holder as in claim 1 wherein said holder is wrapped in ornamental fabric.

3. The portable holder as in claim 2 wherein said fabric is a decorative fabric cover.

4. A form-fitting nail polish bottle holder in combination with a cylindrical nail polish bottle, comprising in combination:

a cylindrical nail polish bottle;

a rigid cylindrical cup having a flat bass, said cylindrical cup further having a compressible resilient foam well fitted herein, said compressible, resilient foam well having a cutout in a center thereof, said cutout formed within said well of compressible, resilient material, holding said bottle of nail polish therein, said rigid cylindrical cup being enclosed by an upwardly extending sleeve of weighted beads, and, said nail polish holder being covered by a decorative fabric outer layer.

5. The portable holder as in claim 4 wherein said well molds to a predetermined shape of the nail polish bottle, thereby holding the bottle securely in place.

* * * * *